US005309953A

United States Patent [19]

Bassi et al.

[11] Patent Number: 5,309,953

[45] Date of Patent: May 10, 1994

[54] ENCLOSURES FOR ELECTROMAGNETS OF SHED-FORMING ASSEMBLIES

[75] Inventors: Dario Bassi, Chaponnay; Damien Bouchet, Decines, both of France

[73] Assignee: Staubli-Verdol S.A., Chassieu, France

[21] Appl. No.: 51,392

[22] Filed: Apr. 23, 1993

[30] Foreign Application Priority Data

Apr. 30, 1992 [FR] France ..... 92 05612

[51] Int. Cl.[5] ..... D03C 3/20

[52] U.S. Cl. ..... 139/455

[58] Field of Search ..... 139/455

[56] References Cited

U.S. PATENT DOCUMENTS 4,739,806 4/1988 Palau et al. ..... 139/455

5,095,952 3/1992 Cheng ..... 139/455 X 5,133,389 7/1992 Griffith ..... 139/455

FOREIGN PATENT DOCUMENTS 3260133 11/1991 Japan ..... 139/455

*Primary Examiner*—Andrew M. Falik

*Attorney, Agent, or Firm*—Dowell & Dowell

[57] ABSTRACT

A shed-forming device in a weaving loom which includes spaced partitions to which are mounted retention hooks controlled by electro-magnets. The electro-magnets are encased in a substantially air-tight manner between adjacent partitions. In the preferred embodiment, oppositely oriented flanges extend from the borders of each partition so as to be engagable with the flanges of adjacent partitions when the partitions are mounted in assembled relationship to thereby form substantially air-tight enclosures.

7 Claims, 3 Drawing Sheets

ENCLOSURES FOR ELECTROMAGNETS OF SHED-FORMING ASSEMBLIES

BACKGROUND OF THE INVENTION

1. Field of the Invention

The present invention relates to devices for forming the shed of a weaving loom including a plurality of assemblies intended to form the shed of the weaving loom.

2. History of the Related Art

U.S. Pat. No. 4,739,806 to Palau et al. discloses a device of the type in question of which the assemblies each include two hooks joined by a funicular element, an electro-magnet and retaining hooks located between two separating partitions joined to each other with a view to producing an independent assembly or module.

It will be readily understood that the pole pieces of the electro-magnets placed between two separating partitions are not isolated from the ambient atmosphere. The ambient atmosphere in a weaving workshop includes fatty dust in suspension is created by waste or flock coming from the weaving yarns and by fine particles of oil and grease in suspension in the air. Such fatty dust tends to be deposited on the pole piece of the electro-magnets which may cause defective operation of the retaining hooks, leading to defects in weaving.

It is an object of the improvements forming the subject matter of the present invention to overcome this drawback and to place each electro-magnet in a substantially air-tight casing.

SUMMARY OF THE INVENTION

To that end, the device according to the invention is characterized in that, adjacent each electro-magnet, each of the faces of the separating partitions includes a border so that, after assembly of two adjacent separating partitions, their opposite borders come into abutment against one another to create a casing containing the electro-magnet.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
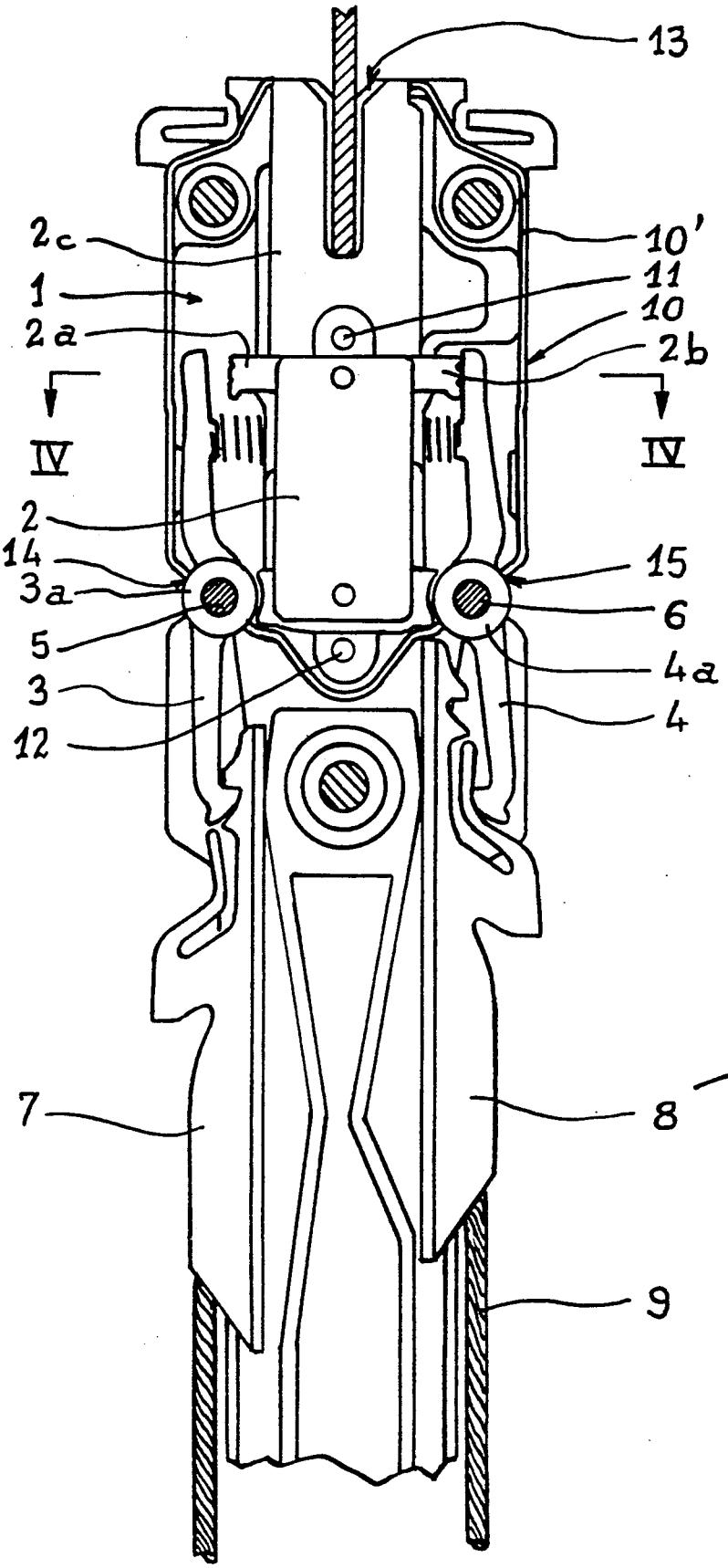
FIG. 1 is a longitudinal section through a shed-forming device applying the improvements according to the invention.

Referring now to the drawings, FIG. 1 shows on a large scale one of the separating partitions 1 of a shed forming device according to U.S. Pat. No. 4,739,806, but incorporating the improvements according to the invention. Between two adjacent separating partitions 1 is housed an electro-magnet 2 having two pole pieces 2*a*, 2*b* made in the form of a transverse branch, as well as two rocking retaining hooks 3, 4 which pivot about pins 5, 6 in the form of a tenon of plastic material secured to the partition 1. Hooks 3 and 4 are provided to retain or leave free the movable hooks 7, 8 connected by a cord 9 and which are displaced in reciprocating motion by two knives (not shown).

Figure 2:
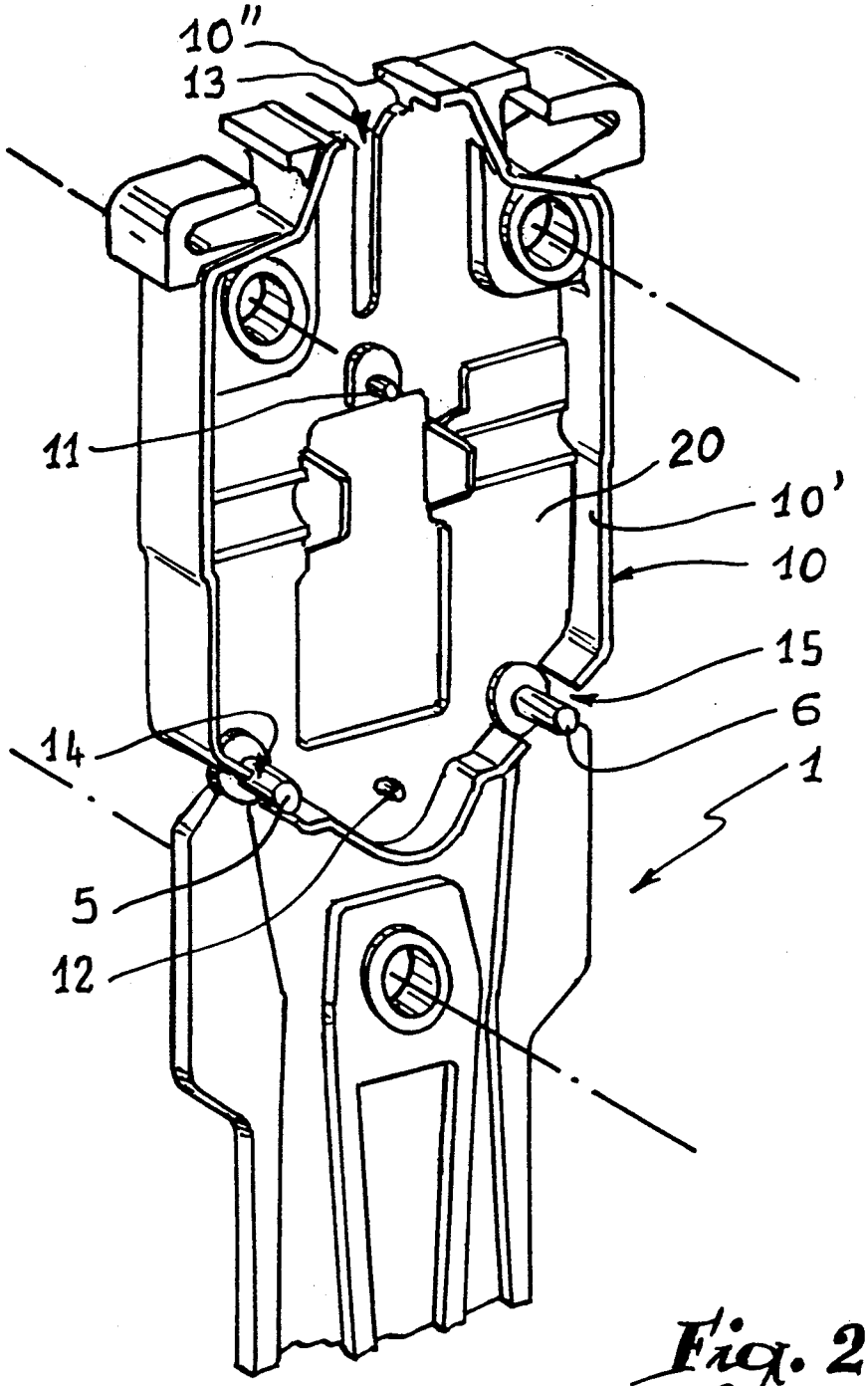
FIG. 2 is a partial perspective view of a separating partition according to the invention.

According to the invention, the end of each separating partition 1 which supports the electro-magnet 2 is provided with a border 10 comprising two flanges 10', 10'' extending on either side of the partition and perpendicular to the faces 20 thereof (FIG. 2). This FIG. clearly shows the two pins 5, 6 which are the pivot pins for the hooks 3 and 4 as well as lugs 11, 12 which engage in corresponding perforations made in the body of the electro-magnet 2 to secure the electro-magnet between two adjacent separating partitions 1.

The border 10 is secured to the lateral edges of the separating partition 1, and with the terminal edge thereof, but a passage 13 is provided in the middle of the edge. Below the electro-magnet, the border 10 takes the form of a rounded V-shaped whose outer extensions are interrupted to provide two spaces 14, 15.

Once the rocking hooks 3, 4 are mounted on their pins 5, 6, the central boss 3*a*, 4*a* of each of them virtually closes the spaces 14 and 15 whose width is equal, to within the operational clearance, to the diameter of the bosses. In addition, an upper extension 2*c* of the electro-magnet 2 substantially closes the passage 13, as illustrated in FIG. 1.

Under these conditions, when two separating partitions 1 are placed near each other and assembled in the known manner, element 10' of the border 10 of a separating partition comes into contact with the element 10'' of the adjacent separating partition, so as to constitute a substantially tight casing in which the electro-magnet 2 is located.

Figure 3:
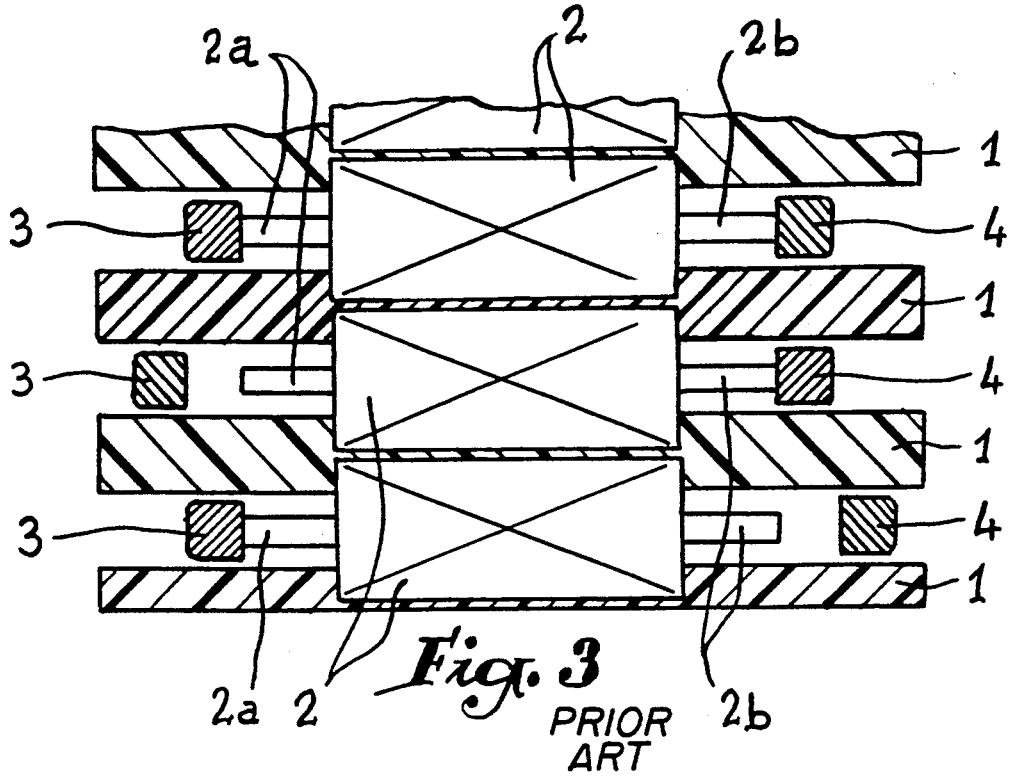
Fig. 3 PRIOR ART
FIG. 3 is a transverse section through a known module, adjacent the pole pieces of its electro-magnets.

FIG. 3 illustrates a shed-forming device according to U.S. Pat. No. 4,739,806, which clearly shows the pole pieces 2*a*, 2*b* located in the atmosphere in which the shed-forming device is placed, without any screen existing between the assembly of these pole pieces and the hooks 3 and 4 with which they cooperate with respect to the ambient air.

Figure 4:
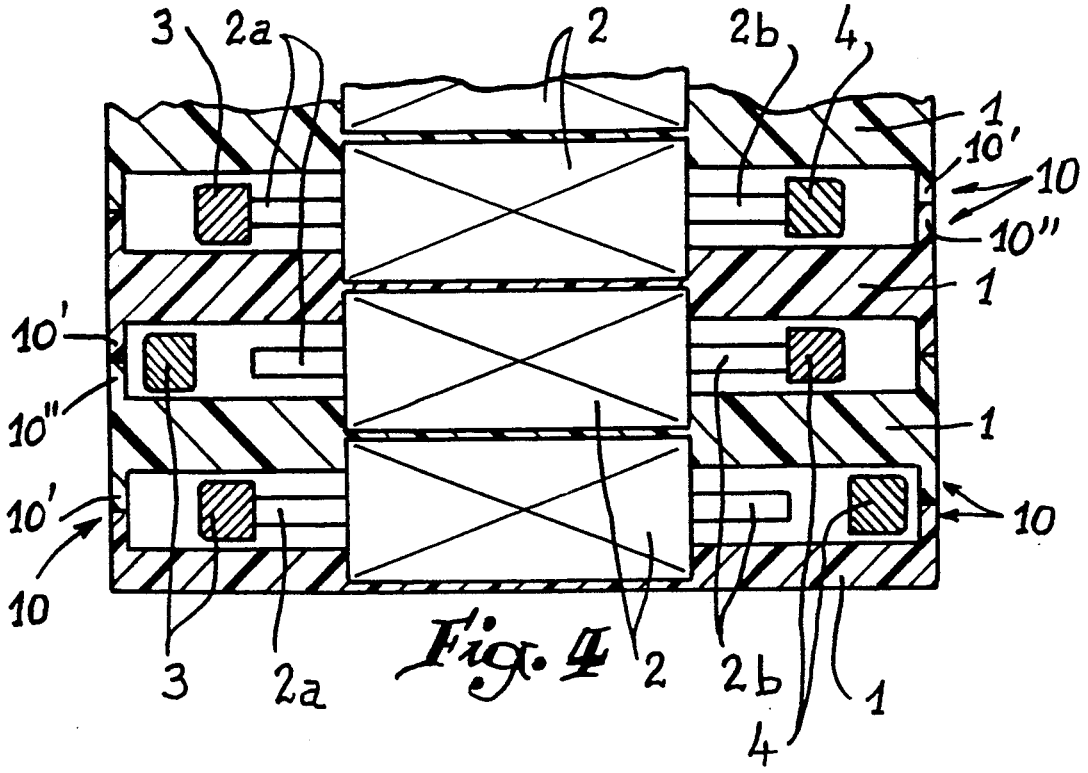
FIG. 4 is a view similar to that of FIG. 1, but showing the section IV—IV (FIG. 1) of a device according to the invention.

On the contrary, and in accordance with the invention, FIG. 4 illustrates a substantially tight casing which includes elements 10', 10'' of two adjacent separating partitions, since the free edges of these elements come into intimate contact.

Of course, the easiest embodiment consists in providing the height of the two elements 10', 10'' of the border 10 to be equal, this height being equal to half the distance separating the opposite faces of two adjacent partitions 1.

A considerable improvement has thus been made to the operation of the shed-forming device of a weaving loom according to U.S. Pat. No. 4,739,806 without any increase in its cost price.

Also, the air-tight casing in which each electro-magnet is located may be made in manner different from the one described without departing from the scope of the invention.

What is claimed is:

1. In a device for forming a shed in a weaving loom which includes a plurality of assemblies each of which includes two movable hooks joined by a funicular element and which are selectively engagable by retaining hooks having first portions thereof mounted between a pair of partitions and second portions for engaging the movable hooks, the retaining hooks being controlled by an electro-magnet means mounted between the pair of partitions and intermediate the first portions of the retaining hooks, and wherein the partitions have opposing faces defined by lateral, upper and lower edges, the improvement comprising; enclosure means for substantially sealing each electro-magnet means from ambient atmosphere between each pair of partitions to thereby prevent contamination of the electro-magnet means.

2. In a device for forming a shed in a weaving loom which includes a plurality of assemblies each of which includes two movable hooks joined by a funicular element and which are selectively engagable by retaining hooks having first portions thereof mounted between a pair of partitions and second portions for engaging the movable hooks, the retaining hooks being controlled by an electro-magnet means mounted between the pair of partitions and intermediate the first portions of the retaining hooks, and wherein the partitions have opposing faces defined by lateral, upper and lower edges, the improvement comprising; flanges extending generally perpendicularly with respect to said faces and on opposite sides of the partitions along the lateral, upper and lower edges thereof so as to define a generally continuous flanged border for the partitions, the flanges of one partition being selectively engagable with opposing flanges of an adjacent partition to thereby define a substantially enclosed housing therebetween when the partitions are assembled in face to face relationship to thereby enclose the electro-magnet means therebetween and within said casing.

3. The device of claim 2 including a pair of spaced openings in said flanges adjacent said lower edges of each partition, a pair of bosses extending from the faces of each partition and within said spaced openings, and the retaining hooks being pivotally mounted about said bosses and substantially closing said spaced openings.

4. The device of claim 3 wherein said flanges include an opening adjacent the upper edge of each partition, a slot in each partition in open communication with said opening in said flanges adjacent said upper edge thereof, and means associated with each electro-magnet means extending through said slot and said opening to substantially close said opening adjacent the upper edge.

5. The device of claim 4 wherein each of the opposing flange elements extends outwardly substantially an equal distance with respect to the opposite faces of each of the partitions.

6. The device of claim 2 wherein said flanges include an opening adjacent the upper edge of each partition, a slot in each partition in open communication with said opening in said flanges adjacent said upper edge thereof, and means associated with each electro-magnet means extending through said slot and said opening to substantially close said opening adjacent the upper edge.

7. The device of claim 2 wherein each of the opposing flange elements extends outwardly substantially an equal distance with respect to the opposite faces of each of the partitions.

* * * * *